US006272899B1

(12) United States Patent
Bentivogli

(10) Patent No.: US 6,272,899 B1
(45) Date of Patent: Aug. 14, 2001

(54) PNEUMATIC-HYDRAULIC RIVET GUN

(75) Inventor: Nerio Bentivogli, Bologna (IT)

(73) Assignee: Ober Utensili Pneumatici S.r.l., Bologna (IT)

( * ) Notice: Subject to any disclaimer, the term of this patent is extended or adjusted under 35 U.S.C. 154(b) by 0 days.

(21) Appl. No.: 09/463,632

(22) PCT Filed: Jul. 27, 1998

(86) PCT No.: PCT/IB98/01148

§ 371 Date: Jan. 25, 2000

§ 102(e) Date: Jan. 25, 2000

(87) PCT Pub. No.: WO99/04917

PCT Pub. Date: Feb. 4, 1999

(30) Foreign Application Priority Data

| | | |
|---|---|---|
| Jul. 28, 1997 | (IT) | B097A0459 |
| Mar. 25, 1998 | (IT) | B098A0197 |
| Apr. 30, 1998 | (IT) | B098A0272 |

(51) Int. Cl.[7] ..... B21J 15/22; B21D 9/05; B25B 27/00

(52) U.S. Cl. ..... 72/391.8; 72/114; 29/243.525; 29/243.526

(58) Field of Search ..... 29/243.523, 243.524, 29/243.525, 243.526; 72/391.4, 391.8

(56) References Cited

U.S. PATENT DOCUMENTS

| | | | | |
|---|---|---|---|---|
| 2,403,675 | | 7/1946 | Mitchell . | |
| 3,555,649 | * | 1/1971 | Rigot et al. | 72/341.8 |
| 3,630,427 | * | 12/1971 | Stokes | 227/59 |
| 4,612,793 | * | 9/1986 | Klein | 72/311 |
| 4,821,555 | * | 4/1989 | Kamata et al. | 72/391 |
| 5,605,070 | * | 2/1997 | Wille | 72/391.4 |

FOREIGN PATENT DOCUMENTS

| | | |
|---|---|---|
| 3701 883 A1 | 8/1988 | (DE) . |
| 0 325 669 A1 | 8/1989 | (EP) . |
| 2 175 231 | 11/1986 | (GB) . |

* cited by examiner

*Primary Examiner*—David Jones
(74) *Attorney, Agent, or Firm*—William J. Sapone; Coleman Sudol Sapone, P.C.

(57) ABSTRACT

A rivet gun includes a pneumatic motor (4), that drives a segment stem 7. A pneumatic cylinder (21) actuates a hydraulic cylinder (22) which sends oil under pressure to an expansion chamber (10) provided for moving back the segment stem (7) and buckling the rivet (2) fixing it to a laminate structure (100). The rivet gun also includes a change-over switching device (30) linked to controls (50,60) for reversing rotation of the motor (4). The controls (60) include an inlet valve (61) operated by a trigger (64) for connecting a compressed air infeed duct 14 with a feed-discharge duct (23) leading to the pneumatic cylinder (21). A discharge valve (63) is disposed in series with the inlet valve (61) and has an adjustment ring (176) for adjusting of the maximum traction force. Another discharge valve (90) is disposed in series with the discharge valve (63) previously mentioned and is provided for adjustment of the stroke of the segment stem (7).

22 Claims, 11 Drawing Sheets

Z
61a
244a
241
64
40
R 205
244a
61a
X1
64
245
244

205
244a
X2
204
244
61a 61a
244

Z
61a
246
64
244
R

PNEUMATIC-HYDRAULIC RIVET GUN

BACKGROUND OF THE INVENTION

1. Field of the Invention

The present invention relates to the technical field concerned with the production of hydraulic, pneumatic, or pneumatic-hydraulic tools.

In particular, the present invention concerns a rivet gun operated by pneumatic-hydraulic means.

The rivet gun is designed for application of rivets provided with an internal thread.

2. Prior Art

It is known that rivets are usually fixed to laminate structures, basically including pieces of rigid sheet made from metal or other suitable materials.

Suitable tools, preferably operated by pneumatic or pneumatic-hydraulic means, are used for fixing the rivets to the laminate structure. These tools take usually the shape of a gun, so that they can be easily handled by an operator who has to apply the rivets to the internal thread.

Among various constructive and operative configurations, the one which uses pneumatic-hydraulic means has resulted to be the most effective, reliable and cheap.

Basically, known rivet guns include each one a hollow tool body, symmetrical with respect to a longitudinal axis. A handle made integral with the body, extends downwards therefrom.

The body of the tool features inside and in the fore part, a cylindrical channel having variable diameter and, in the rear part, a cylindrical chamber. The chamber includes a reversible pneumatic engine, that is connected to a stem, named in the following as rivet holding stem, that goes outside in the region of the head of the rivet gun.

The rivet holding stem is therefore rotated by the motor. The rivet holding stem is also threaded along the portion protruding outwards from the rivet gun head.

The tip portion of the rivet holding stem can be replaced, when needed, with other similar portions having different diameters, to mount rivets of different diameters.

The pneumatic engine is driven into rotation, usually in clockwise direction, by a blow of compressed air which is supplied through an input duct. A suitable push button allows or cuts off the blow of air.

The compressed air to be discharged goes out of the engine, with a lower pressure, via a discharge duct and, partially, through intermediate discharge holes.

Reverse rotation of the engine is obtained by means of a change-over switching device, that is also located in the handle. When operated, the change-over switching device closes the input duct and deviates the blow of air to the discharge duct. The discharge duct, in reversed condition, works as a supply duct. Discharge to the outer environment takes place by passing the discharge air through the clearances always present in the connection regions of the various components of the pneumatic engine.

It is clear enough that, with such constructive configuration, reverse rotation, or counter-clockwise rotation, of the pneumatic engine cannot be efficient and the resulting torque is rather small.

The pneumatic engine-rivet holding stem assembly may also move axially backwards, against a spring which normally keeps it in an advanced position. The stroke of the assembly motion is suitably delimited by stop surfaces.

The axial motion of the pneumatic engine-rivet holding stem assembly is determined by a hydraulic system, that includes an expansible chamber supplied with oil under pressure coming from an hydraulic cylinder via an input duct.

The hydraulic cylinder is located in the upper part of the handle of the rivet gun. The expansible chamber is located in front of the pneumatic engine in the rear chamber of the rivet gun.

The hydraulic cylinder is in turn operated by a pneumatic cylinder, that has a wider cross section and is located in the lower part of the handle. The pneumatic cylinder is supplied with air under pressure coming from the same source which feeds the pneumatic engine, via suitable ducts.

The pneumatic cylinder is operated by means of a second push button located in the front part of the handle. The second push button operates a valve, that allows air under pressure to enter the pneumatic cylinder.

In this case, the piston of the pneumatic cylinder goes up, and the stem of the piston pushes upwards the piston of the hydraulic cylinder. In fact, the stem of the pneumatic piston forms the piston of the hydraulic cylinder located thereabove. The oil under pressure in the hydraulic piston is moved to the expansible chamber, that in turn moves the pneumatic engine-rivet holding stem assembly backwards.

Basically, the system including the pneumatic cylinder and the hydraulic cylinder forms a pressure booster, that permits to apply a very strong backward force to the pneumatic engine-rivet holding stem assembly while moving it backwards.

Operation of the known rivet gun described hereinabove, to apply an internal thread rivet to a laminate structure, takes place as follows:

- a rivet having internal diameter and thread corresponding to those of the rivet holding stem, is set on the tip of the latter;
- the pneumatic engine is operated with direct rotation (clockwise), so that the rivet holding stem is also rotated and the rivet is screwed on the threaded tip of the rivet holding stem;
- then the rivet is placed into a corresponding hole made in the laminate structure and in abutment against a frontal surface thereof;
- backward motion of the pneumatic engine-rivet holding stem assembly is performed very quickly and with very big force, as previously described, and the intermediate portion of the rivet protruding beyond the hole of the laminate structure is buckled against the backside of the structure, so that the rivet is fixed;
- lastly, the reverse operation push button is activated for reverse rotation of the pneumatic engine, so that the rivet holding stem is unscrewed from the rivet.

The rivet guns like the one described hereinabove, have some drawbacks which make their use difficult and scarcely efficient.

First of all, this technique used to reverse the rotation of the pneumatic engine makes it poorly efficient right when a very high torque would be necessary, i.e. when the tip of the rivet holding stem must be extracted from the rivet. In fact, when the rivet is buckled, the internal thread becomes damaged and anyway does no longer extend in a perfect line. Therefore, to extract the rivet holding stem from the rivet the torque exerted thereon must be higher than the one applied during the screwing step.

There are also known rivet guns in which, to overcome this serious inconvenience, the pneumatic engine is operated in reverse rotation when the stem is screwed into the rivet, and then the engine is operated with direct rotation when the stem must be extracted from the rivet. This solution actually improves the effectiveness of the rivet gun, but the screwing step becomes often difficult and slow, so that the problem cannot be said to be completely solved.

Another problem encountered with the rivet gun like the one described above, is that only the extension of the stroke of the stem can be adjusted and varied in relation to different operation conditions. In other words, when the stems has moved to cover a pre-established stroke, the rivet gun is deactivated. On the contrary, the actuating pressure cannot be adjusted. This lack of adjustment possibility for the rivet gun, provokes a risk of subjecting the rivets to excessive traction force or, in the opposite case, the rivets though buckled, do not have an adequate traction force.

A further problem which can be found in the rivet guns of this kind, derives from the fact that the controls for operation of the various steps are located separately and in different parts of the handle. This fact renders more difficult the work of an operator, in particular when the rivets must be applied to positions which cannot be easily reached.

Document EP-A-0 325 699 relates to a hydropneumatic gun for setting blind-rivet nuts, in which an air piston fitted in an air cylinder is moved to pressurize oil housed in the gun body, causing an oil piston to be retracted, so that a screw mandrel attached to the oil piston at its tip is retracted to the inner part of the gun body, thereby to exert a deforming force to the sleeve of a nut threadedly mounted on the screw mandrel. The hydropneumatic gun further comprises an air motor to be rotated by com pressed air, an air motor driving air guide passage, an air motor forward/reverse changeover mechanism for switching the rotation direction of the air motor, and a power transmission mechanism for transmitting an air motor riving force to the screw mandrel. A series of operations of the screw mandrel such as forward rotation, stop of the rotation, retraction, reverse rotation and advancement can thus be carried out smoothly and sequentially. An air motor driving air guide passage is provided between the air motor and a compressed air supply port in the gun body, while a power transmission mechanism transmits an air motor forward/reverse rotation from the air motor to the screw mandrel.

An air piston moving air guide passage is provided between the compressed air supply port and an air guide hole in the air cylinder at the air piston moving side, while a spool is slidably fitted in a communication hole communicating with the air piston moving air guide passage for opening and closing the air piston moving air guide passage. The spool is moved by a spool controlling air guide chamber between the communication hole and the compressed air supply port, in such direction as to close the air piston moving air guide passage.

A discharge passage is provided between the air guide chamber and a compressed air discharge port in the vicinity of the power transmission mechanism, in the gun body, for discharging compressed air guided in the air guide chamber, while a clutch of the power transmission mechanism is disposed in the discharge passage as a member for opening and closing the discharge passage, that is adapted to be opened when the clutch is rotated to a predetermined angle position by predetermined turning torque.

SUMMARY OF THE INVENTION

The object of the present invention is to propose a pneumatic-hydraulic rivet gun in which all the operative steps are performed with high efficiency, no matter of the operative conditions.

This means that the pneumatic engine must give the maximum torque with both direct and reverse rotation.

A further object of the present invention is to propose a rivet gun which has simple and quick controls provided for performing each operative step in sequence, no matter of the operative conditions.

Yet a further object of the present invention is to propose a pneumatic-hydraulic rivet gun in which both the motion stroke of the rivet holding stem and the actuation pressure acting on the rivet holding stem can be adjusted, so that the rivet gun is deactivated when the suitable fixing condition is reached for the rivet, i.e. the traction force of the rivet when fixed has reached an ideal value.

Yet a further object of the invention is to propose a rivet gun in which the above mentioned controls for performing the operative steps can be operated by a pressure on a single gun trigger.

Another object of the invention is to obtain the previously mentioned objects by means of a rivet gun with a compact constructive configuration, easy to handle and very reliable.

Yet a further object of the invention is to propose a rivet gun in which the threaded tip of the rivet holding stem can be easily replaced with other tips of low cost and readily available on the market.

The above mentioned objects are obtained, in accordance with the content of the claims, by means of a pneumatic-hydraulic operated rivet gun, including;

an elongated casing featuring inside a rear cavity and a fore channel, substantially cylindrical, aligned with said rear cavity along a longitudinal axis, with said fore channel connected to said rear cavity and opened outside in the region of a fore end of said casing;

at least one pneumatic motor, housed axially inside said rear cavity;

at least one segmented stem situated in said fore channel in succession with said pneumatic motor and axially connected with an output shaft of said motor, with a threaded terminal portion of said stem going out from said fore end for receiving a rivet internally threaded, said pneumatic motor and segmented stem sliding axially and in opposite directions inside said rear cavity and fore channel, against first elastic means;

at least one hollow handle extending from a lower side of said casing and forming, in its lower part, at least one pneumatic cylinder, and its upper part, at least one hydraulic cylinder operated by said pneumatic cylinder and aimed at imposing said pneumatic motor and segmented stem axial sliding;

said pneumatic-hydraulic rivet gun being characterized in that it includes, inside said rear cavity, a change-over switching device, connected to an input duct of said pneumatic motor via at least on pneumatic supply duct, and to a discharge duct of said pneumatic motor via at least one pneumatic discharge duct, said change-over switching device being provided for supplying, said pneumatic motor via said supply duct with a flow of compressed air coming from an infeed duct, during the direct rotation and in accordance with first control means, while discharging said compressed air via said discharge duct, and being provided for supplying said pneumatic motor via said discharge duct with a flow of compressed air coming from said infeed duct during reverse rotation and in accordance with second control means, while discharging said compressed air via said supply duct.

BRIEF DESCRIPTION OF THE DRAWINGS

The technical features of the present invention are set forth in the following, having reference to the accompanying drawings, in which.

PREFERRED MODES OF CARRING OUT THE INVENTION

Figure 1:
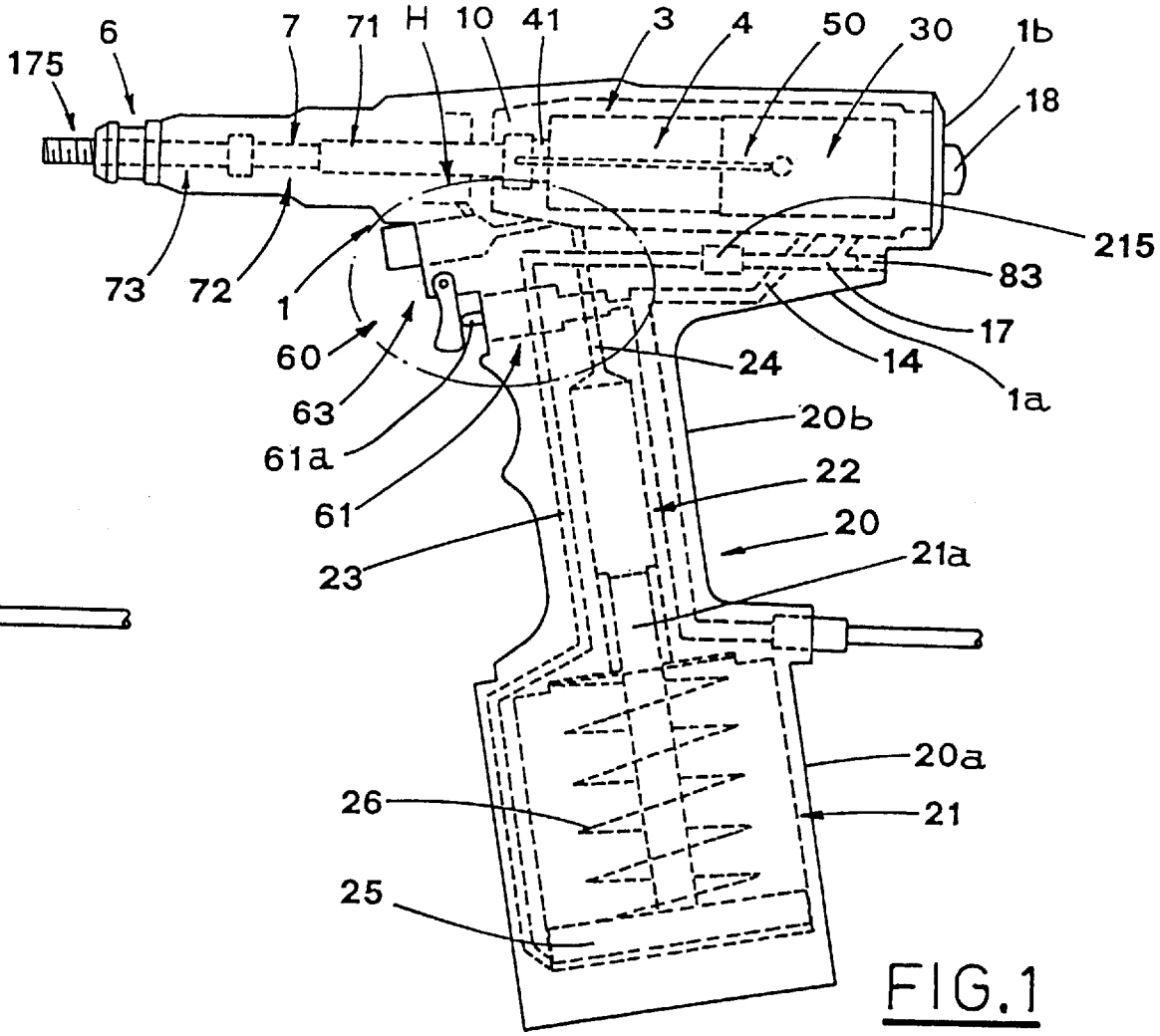
FIG. 1 shows a schematic side view of a rivet gun manufactured in accordance with the present invention.
Figure 2:
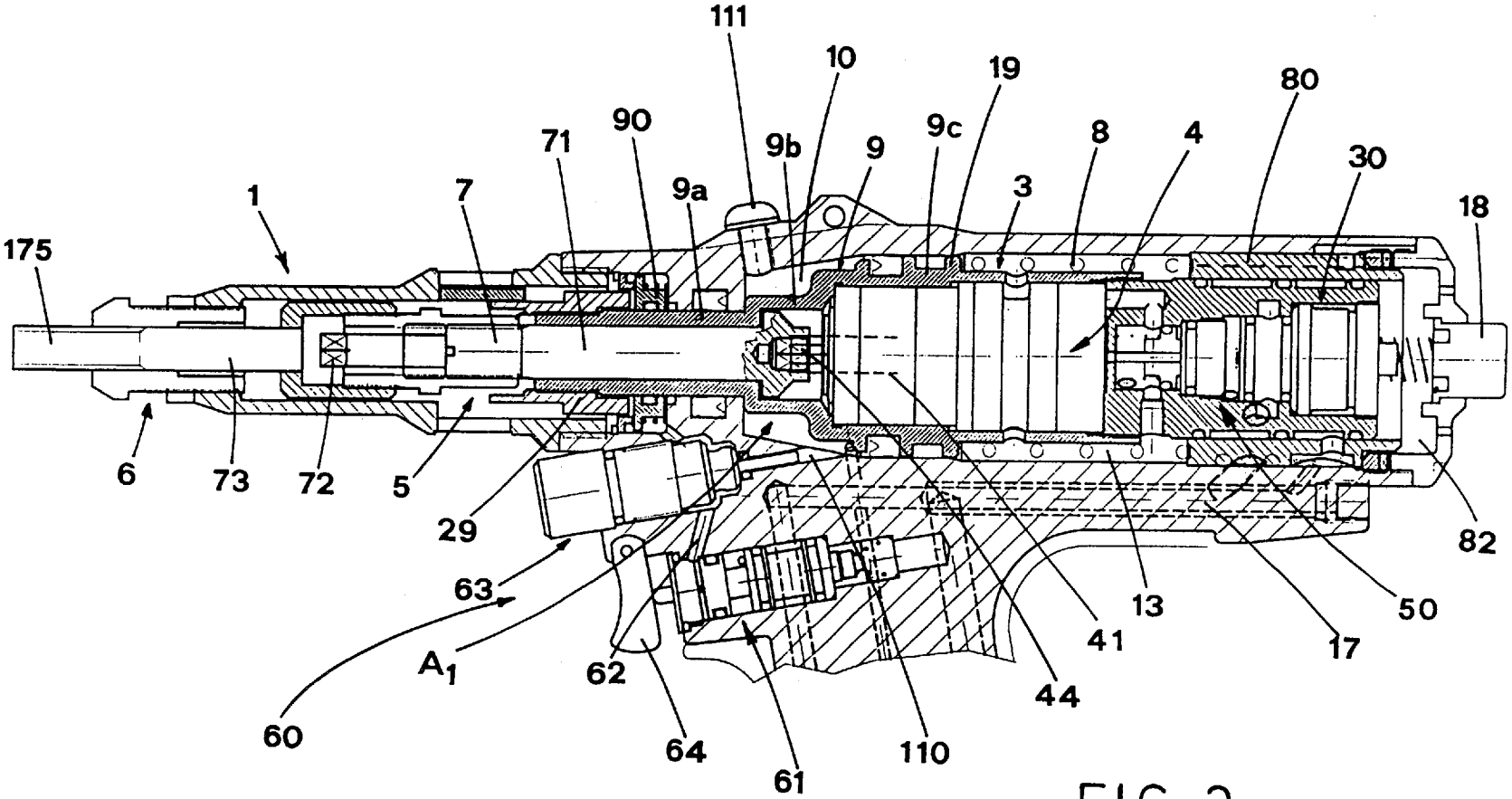
FIG. 2 shows an enlarged, more detailed, side view of the body of the rivet gun of FIG. 1.

With reference to FIGS. 1 and 2, numeral 1 indicates the casing of a rivet gun manufactured according to the present invention. The casing is preferably made of metal or other suitable material.

This casing has an elongated shape and is formed by portions with gradually decreasing diameters, beginning from a rear end 1*b* up to the fore end 6.

A hollow handle 20 extends downwards from the lower side 1*a* of the casing 1, approximately from its middle part The inner part of the casing 1 features a rear shaped cavity 3 and a fore channel 5 substantially cylindrical. The rear cavity 3 and the fore channel 5 are aligned along a casing longitudinal middle axis.

The rear cavity 3 takes the whole of the rear part of the casing 1 and communicates with outside through suitable holes, not shown, made in the casing 1.

The rear part of the fore channel 5, that is located in the fore part of the casing 1, communicates with the cavity 3, while its fore part opens outward in the region of the fore end 6 of the casing.

A sleeve-like open-ended element 9, having a shaped profile, is situated inside the casing 1, in coaxial relation therewith.

Figure 6:
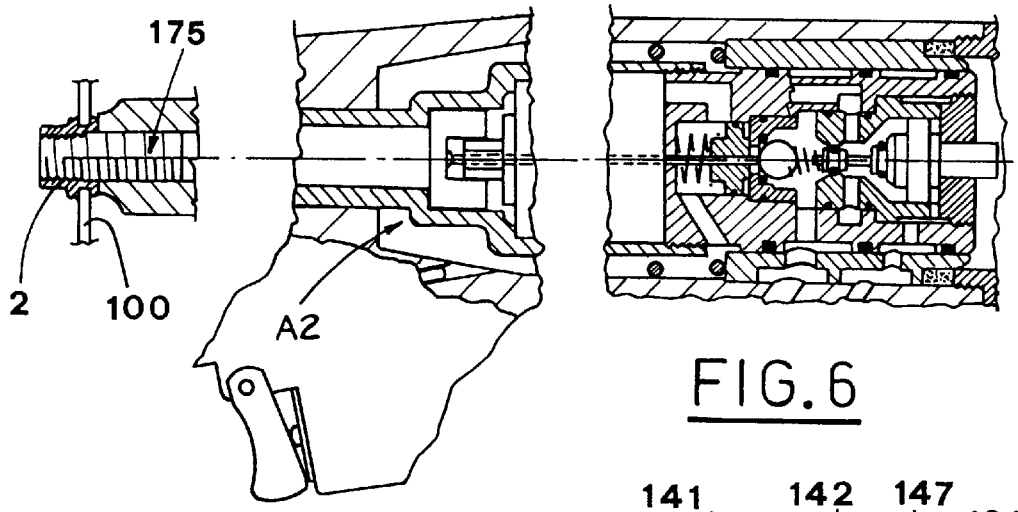

This element 9 slides axially between a forwarded position A1 (FIG. 2) and a backward position A2 (FIG. 6).

Basically, the element 9 includes a plurality of cylindrical portions, namely a fore portion 9*a*, an intermediate portion 9*b* and a rear portion 9*c*, whose diameter gradually increases.

The outer diameter of the fore portion 9*a*, situated in the fore channel 5, is equal to the inner diameter of the channel 5.

The external part of the fore portion 9*a* is threaded, so that a ring nut 29 can be screwed therein. The aim of the ring nut is to adjust the stroke length.

The intermediate portion 9*b* and the rear portion 9*c* are located in the rear cavity 3.

The rear portion 9*c* is externally provided with a ring-like shoulder 19, whose external diameter is equal to the internal diameter of the rear cavity 3.

The ring-like shoulder 19, together with the external surfaces of the intermediate portion 9*a* and a part of the rear portion 9*c*, delimit an expansible chamber 10 supplied with oil under pressure.

The ring-like shoulder 19, together with a part of the rear portion 9*c*, delimit a ring-like chamber 13 situated inside the rear cavity 3.

This ring-like chamber 13 houses first elastic means 8, constituted by a helical spring which extends between the ring-like shoulder 19 and a bushing 80 (FIG. 4), firmly fastened to the rear cavity 3.

The upper part of the bushing 80 features a longitudinal fin structure 81 which creates a connection between the ring-like chamber 13 and an outlet chamber 82, in its turn connected with outside.

A pneumatic motor 4, of known type, is situated in the rear portion 9*c* of the sleeve-like element 9.

The motor 4 has an output shaft 41 disposed axially. The shaft 41 features an axial hole 41*a* (FIG. 4) and, in its fore part, a polygonal head 44.

Figure 9:
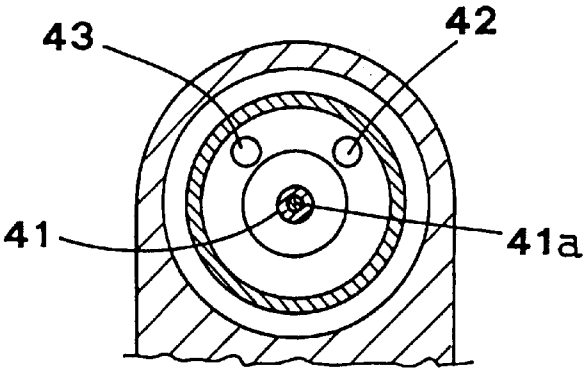
FIG. 9 shows a section view taken along the line IX—IX of FIG. 2.

According to known techniques, in the motor 4 there are made a compressed air input duct 42 and a output duct 43 (see also FIG. 9).

These ducts 42, 43 are suitably situated at the rear head 4*a* of the motor 4, offset by about 45°.

A change-over switching device 30, fastened to the rear part of the motor 4 and coaxial therewith, supplies the motor 4 with a blow of compressed air through the input duct 42, when direct rotation is selected, while when reverse rotation is selected, the compressed air is supplied through the output duct 43, in accordance with the position of first control means 50.

The change-over switching device 30 protrudes from the rear part of the sleeve-like element 9 and slides tightly in the rear part of the rear cavity 3.

The change-over switching device 30 includes a substantially cylindrical body 131 (see also FIG. 3), that features internally a plurality of airtight chambers set into communication with each other. A fore chamber 135 is situated near the motor 4, an intermediate chamber 136 is located in the middle portion of the body and a rear chamber 137 is located at the end of the body opposite to the motor.

The intermediate and rear chamber communicate with each other via a bore 144.

A supply duct 132 extends from the rear upper part of the fore chamber 135 of the body 131 and is connected to the input duct 42 of the motor 4.

A for-reverse-operation discharge duct 138 extends from the fore lower part of the fore chamber 135 and opens into the ring-like chamber 13.

Figure 3:
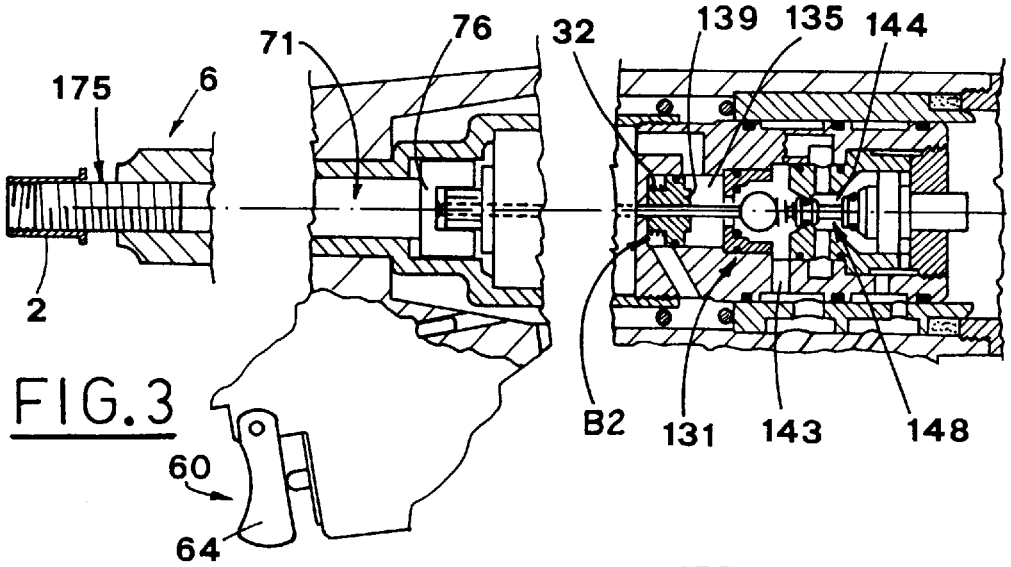
FIGS. 3,4,5,6,7,8 show respectively particulars of the rivet holding stem head, of the handle and distributor of the rivet gun of FIG. 2, in subsequent working steps.

A first reverse operation block 139, situated in the fore chamber 135, slides tightly and longitudinally inside this chamber, in opposition to second elastic means 32, between a rearward position B1 (FIG. 2) and a forward position B2 (FIG. 3).

The second elastic means 32 are formed by a suitable helical spring which maintains this first block 139 in the rearward position B1, when no other forces act thereon.

In this position, the supply duct 132 and the for-reverse-operation discharge duct 138 communicate with each other.

A first valve 141 is situated between the fore chamber 135 and the intermediate chamber 136; this is preferably a ball valve and includes third elastic means 142 constituted by a helical spring situated axially in the intermediate chamber 136.

The first valve 141 is operated by the above mentioned first control means 50 and when it is not operated, it prevents the communication between the above mentioned chambers.

A compressed air inlet duct 143, connecting the intermediate chamber 136 with a compressed air infeed duct 14, is also situated in the cylindrical body 131 of the change-over switching device 30.

The air infeed duct 14 extends in the lower and rear part of the casing 1, then in the above mentioned handle 20 and finally opens at the back of the handle.

The air infeed duct 14 is connected to a compressed air source of known type and not shown.

A discharge duct 133 starts from the bore 144 and goes out of the cylindrical body 131 in the region of the output duct 43 of the motor 4.

A second reverse operation block 145 is situated in the rear chamber 137 and has a plunger 147, that slides axially in airtight condition in the chamber 137.

The plunger 147 has in its rear part a hollow cylindrical extension 149. This cylindrical extension 149 passes through an axial hole 150 made in the rear end 131*a* of the body 131 and makes the rear chamber 137 communicate with the rear cavity 3.

A ring-like recess 151 is made at the back part of the plunger 147, thus surrounding the hollow extension 149, so as to define a variable part of the rear chamber 137.

The ring-link recess 151 communicates with an exhaust duct 17 via a reverse operation control aperture 146.

The exhaust duct 17 is made in the lower part of the casing 1 and extends on one side toward the handle 20 and generally towards the fore end 6 of the casing. On the other side, the exhaust duct 17 extends towards the rear surface 1*b* of the casing, up to a flow adjustment valve 83, that opens outside.

The front surface of the plunger 147 supports two tandem valves 148, which are concentric with the plunger.

Accordingly, the second reverse operation block 145 is moved, in relation to certain conditions of the first reverse operation block 139, by the plunger 147.

A backward position C1 (FIG. 4) for the second reverse operation block 145 is determined by the third elastic means 142 of the ball valve 141. In this position C1, the ring-like recess is small and the tandem valves 148 are set to prevent communication between the bore 144 and the intermediate chamber 136 while allowing communication between the bore 144 and the rear chamber 137.

When the plunger moves the second reverse operation block 145, in contrast to the third elastic means 142 of the ball valve 141, to a forward position C2 (FIG. 8), communication between the bore 144 and the rear chamber 137 is prevented while communication between the bore 144 and the intermediate chamber 136 is allowed.

Figure 4:
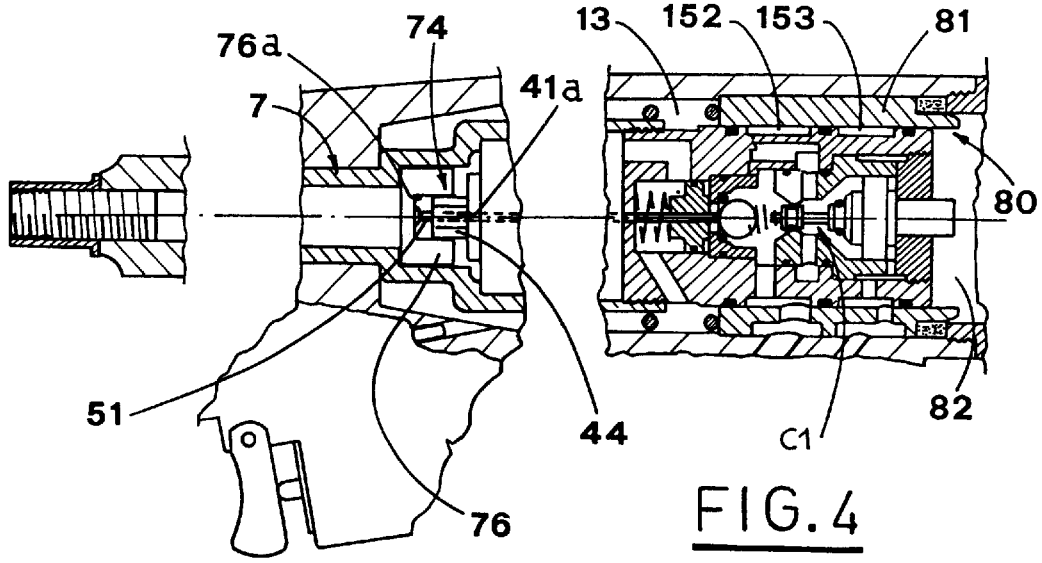

Two annular grooves, namely a first annular groove 152, and a second annular groove 153, are made on the external surface of the body 131 (FIG. 4). The task of these annular grooves is to provide a communication between the intermediate chamber 136 and the infeed duct 14, and between the rear chamber 137 and the reverse operation control channel 146.

A segmented stem 7 is rotatably and slidably disposed in the fore channel 5 (FIG. 2) after the pneumatic motor 4 and axially joined to the shaft 41 thereof.

A threaded terminal portion 175 of the stem 7 goes out of the fore end 6 of the casing 1 and is designed to receive an internally threaded rivet 3.

The motor 4 is coupled with the segmented stem 7 in the region of the intermediate portion 9*b* of the sleeve-like element 9, by shape-coupling means 74 (FIG. 4).

These shape-coupling means 74 include the above mentioned polygonal head 44, having hexagonal section, and a socket head 76 made at the rear end of the segmented stem 7.

The section of the head 76 socket 76*a* is complementary to the section of the polygonal head 44.

Therefore, the segmented stem 7 slides axially with respect to the motor 4.

Moreover, the motor 4 and the stem 7 slide together, since both are coupled to the sleeve-like element 9, against the first elastic means 8.

In particular, the segmented stem 7 features a rear cylindrical segment 71, which is partially housed in the rear portion 9*c* of the sleeve-like element 9 and which features the socket head 76 at its rear part.

An intermediate segment 72 is axially and removably fixed to the rear segment 71, inside the fore channel 5.

The intermediate segment 72 is advantageously constituted by a connector with a standard hexagonal head, which can be substituted with other connectors having hexagonal heads of different size.

The fore segment 73 is advantageously formed by a standard screw with a hexagonal socket head, which fits on the connector 72 and whose threaded terminal portion 175 protrudes from the fore end 6 of the casing 1.

Like the connector, this screw can be easily substituted with other screws having threaded terminal portions 175 of different diameter.

The first control means 50 include the segmented stem 7 and a rod 51 (FIGS. 1, 2 and 4). The rod 51 is situated between the first valve 141 of the change-over switching device 30 and the polygonal head 44 of the shaft 41. The rod 51 is in coaxial relation with the shaft 41 and protrudes from the polygonal head 44 of for a short piece.

The bottom of the socket 76*a* of the stem 7 touches the fore end of the rod 51. Also, the rod 51 slides inside the hole 41*a* and pass through an axial hole made in the first reverse operation block 139.

The handle 20 (see in particular FIG. 1) includes, in its lower part 20*a*, a pneumatic cylinder 21 having big section, and in its upper part 20*b*, a hydraulic cylinder 22 having smaller section, made coaxial with the pneumatic cylinder 21.

The upper part of the stem 21*a* of the pneumatic cylinder 21 acts substantially as a piston of the hydraulic cylinder 22, so that in this way the pressure is increased.

The hydraulic cylinder is connected to the expansible air-tight chamber 10 through an oil supply duct 24.

The piston 25 of the pneumatic cylinder 21 works against a helical spring 26, which maintains this pneumatic cylinder 21 empty, if no other forces occur.

The pneumatic cylinder 21 is supplied by a feed-discharge duct 23, that connects the lower end of the pneumatic cylinder 21 and the infeed duct 14 and the exhaust duct 17, with the interposition of second control means 60.

The second control means 60 are situated near the upper-fore end of the handle 20 and include an inlet valve 61, connecting the infeed duct 14 with the feed-discharge duct 23, and a discharge valve 63, situated directly over the inlet valve 61.

The discharge valve 63 and the inlet valve 61 are arranged in series and are connected by a connecting duct 62.

The front part of the inlet valve 61 is closed by a screw plug 165. A push button 61*a*, operated by a trigger 64, passes air-tightly through the screw plug 165.

A pin 61*b*, axially integral with the push button 61*a*, passes freely through an axial hole 65*a* made in a piston 65, slidably mounted in the seat 66 of the valve 61.

The pin 61*b* carries at its end a closing pinhead 67 which closes the axial hole 65*a* of a tubular shank 65*b* made integral to the piston 65.

The tubular shank 65*b* slides tightly through a jacket 68 mounted inside the seat 66. The jacket 68 features externally a ring groove 68*a* connected to the feed-discharge duct 23.

This groove 68*a* communicates, through radial holes 68*b*, with another groove 65*c* made on the outer surface of the tubular shank 65*b*.

The closing pinhead 67 is pushed by a helical spring 69, that rests on the bottom 66*a* of the seat 66.

The infeed duct 14 opens in the region of the bottom 66*a* of the valve seat 66.

The discharge valve 63 includes a hollow body 70 situated inside a relative seat in air-tight condition, which leaves at its bottom a clearance 74, into which the connecting duct 62 opens.

Another duct 75, communicating with the bottom 5*a* of the channel 5, extends from this clearance 74.

The body 70 ha an internal thread, so as to receive in screw engagement an adjustment ring 176, which pushes a helical spring 77 acting elastically on a closing bolt 78.

The closing bolt 78 closes air-tightly the opening of a tubular prominence 70*a* of the body 70.

The closing bolt 78 is axially guided along this tubular prominence 70*a* by means of a shank 78*a* which enters air-tightly a hole 110 communicating with the expansible airtight chamber 10.

The prominence 70*a* features also radial holes 70*b*, communicating with the above mentioned clearance 74.

Another discharge valve 90, situated in the region of the bottom 5*a* of the channel 5, is substantially formed by a ring 91 mounted slidably on the fore portion 9*a* of the sleeve-like element 9 and, yielded by a spring 92, so as to seal a shoulder ring 93 fastened inside the channel 5.

Now, operation of the pneumatic-hydraulic rivet gun will be described, with particular reference to Figures from 3 to 14, beginning from a situation, in which:

the sleeve-like element 9 is in its forwarded position A1 (FIG. 2);

the first reverse operation block 139 is in its rearward position B1;

the first valve 141 closes the passage between the fore chamber 135 and the intermediate chamber 136;

the second reverse operation block 145 closes the passage between the intermediate chamber 136 and the bore 144, while keeps open the passage between the bore 144 and the rear chamber 137;

the trigger 64 is raised and keeps closed the inlet valve 61.

In this condition, compressed air is supplied by the infeed duct 14 to both the intermediate chamber 136, and to the bottom 66*a* of the seat 66 of the inlet valve 61.

Figure 2A:
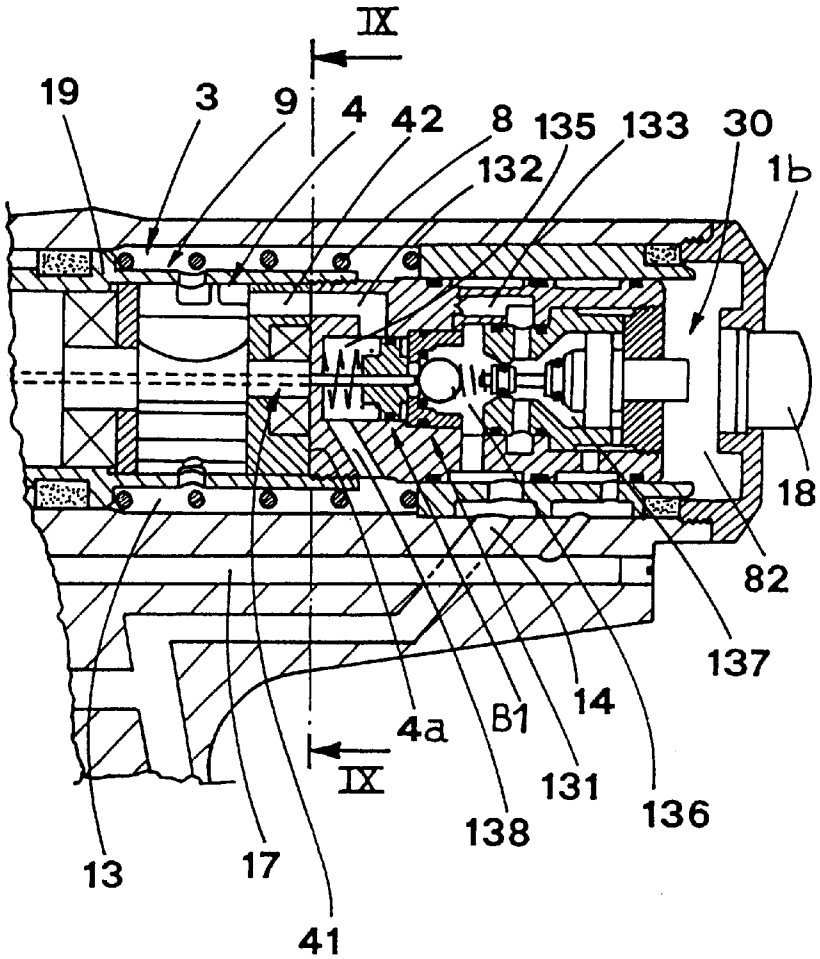
FIG. 2*a* shows a view, still more detailed, of the rear part of the body of FIG. 2.

The intermediate chamber 136 is set under pressure and the air does not proceed further (FIG. 2*a*).

Figure 10:
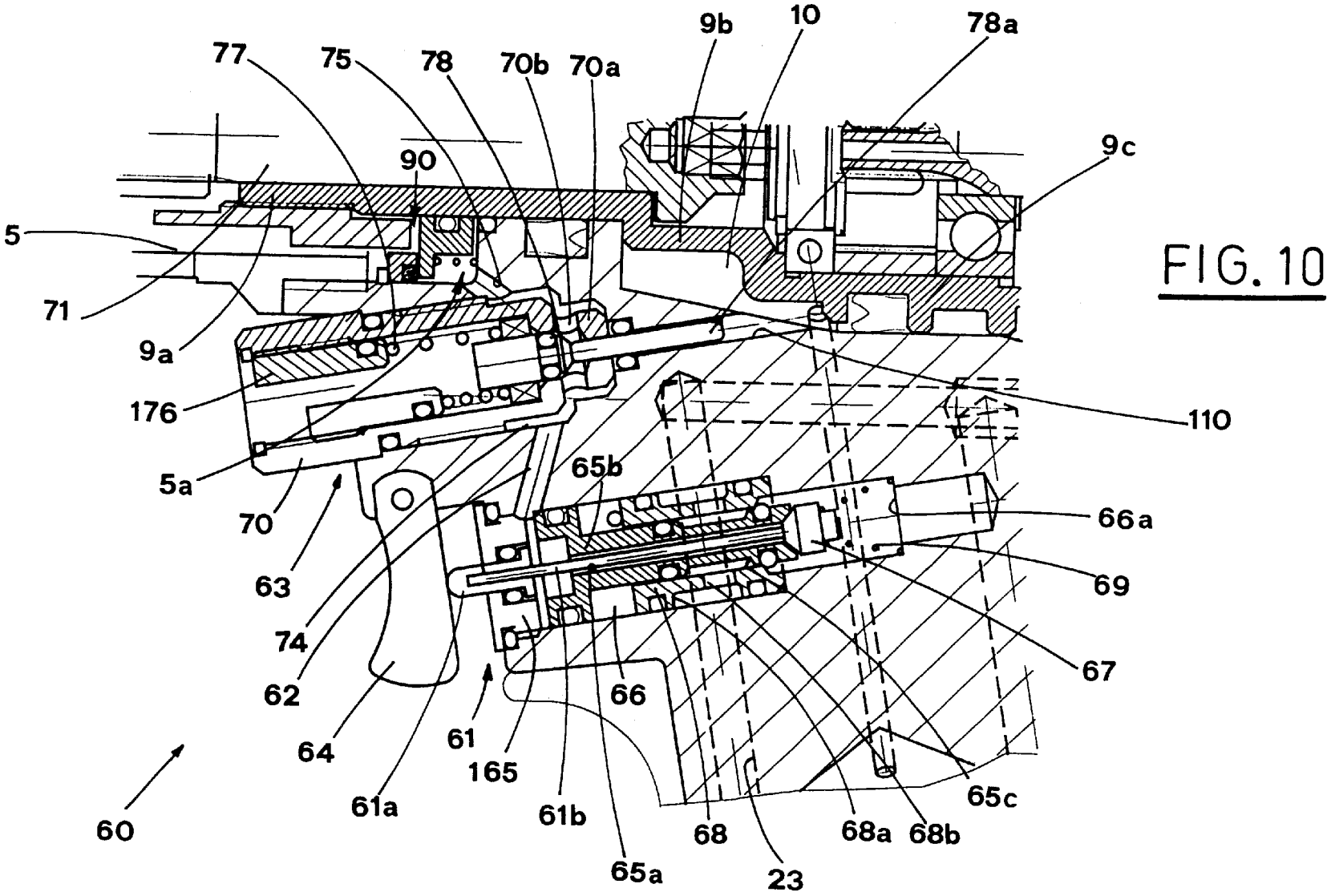
FIGS. 10,11,12,13 and 14 show respectively a longitudinal section of an enlarged part H of the above mentioned body of the rivet gun, in subsequent working steps.
Figure 11:
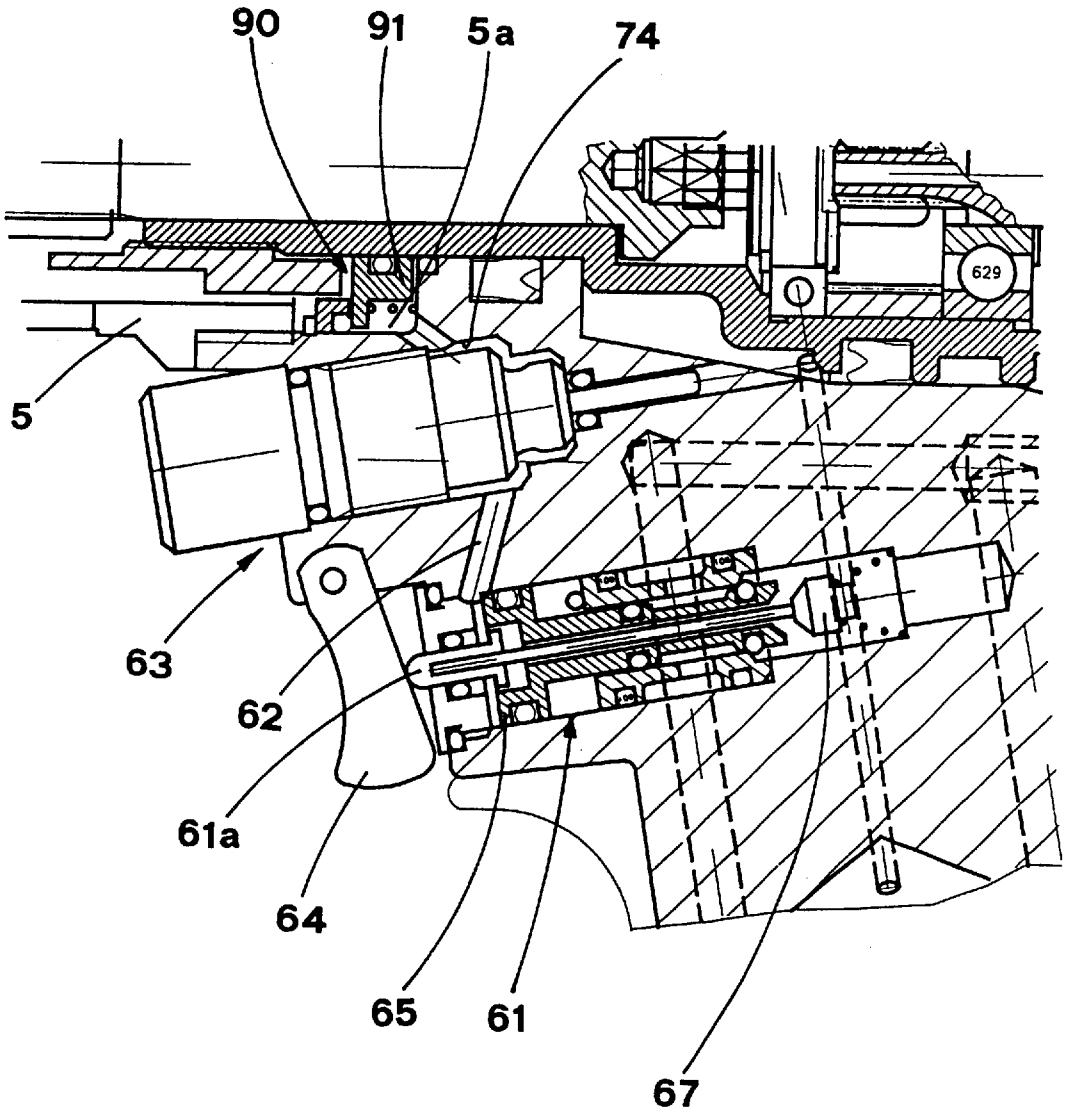

Also the compressed air supplied to the seat 66 of the valve 61 does not proceed further because of the action of the closing pinhead 67, which closes the axial hole of the piston 65 (FIG. 10).

In order to fasten a rivet 2 to a laminate structure 100, the user must first align the threaded hole of this rivet with the end of the terminal portion 175 of the segmented stem 7, and then, slightly push axially this segmented shaft.

Due to this action, the shaft slides backward and its socket head 76 pushes the rod 51, making it slide thus opening the first valve 141.

This results in the compressed air being supplied to the fore chamber 135, and consequently, in the first reverse operation block 139 sliding up to its forwarded position B2 (FIG. 3), in which it closes the for-reverse-operation discharge duct 138.

Therefore, the compressed air flows toward the supply duct 132, and then to the motor 4, making it rotate clockwise, or directly.

Then, the compressed air goes out from the output duct 43 and flows toward the discharge duct 133, from where it moves to the bore 144, to the rear chamber 137 and then, via the hollow extension 149, to the outlet chamber 82 and subsequently outside.

Due to rotation of the segmented stem 7, the rivet 2 is screwed onto the terminal portion 175, until the rivet strikes the fore end 6 (FIG. 4).

At this point, the valve 141 stops the passage of the compressed air in the fore chamber 135 thus bringing the first reverse operation block 139 back to its rearward position B1 and then restoring the initial conditions.

Figure 5:
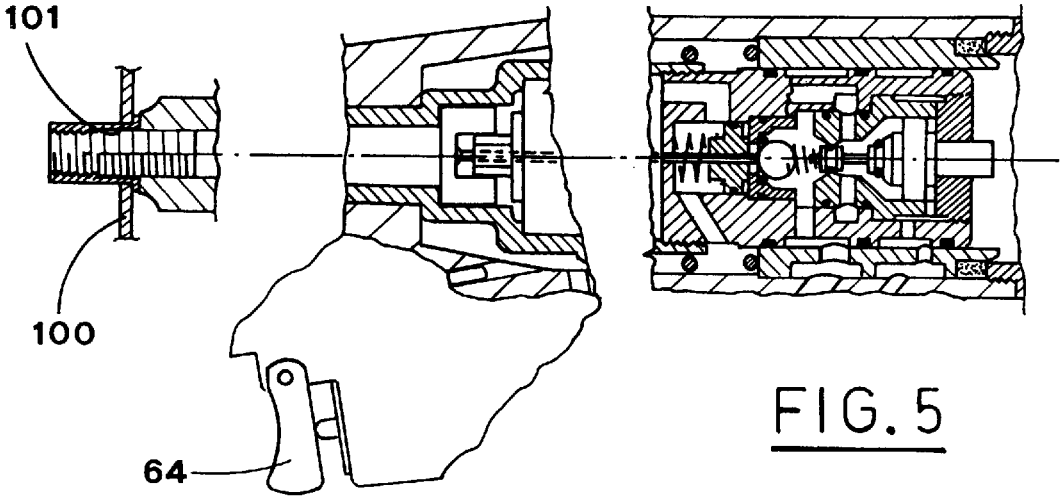

Then, the rivet 2 is introduced into the hole 101 (FIG. 5) and the trigger 64 is pushed, so as to act on the push button 61*a* of the inlet valve 61.

Figure 12:
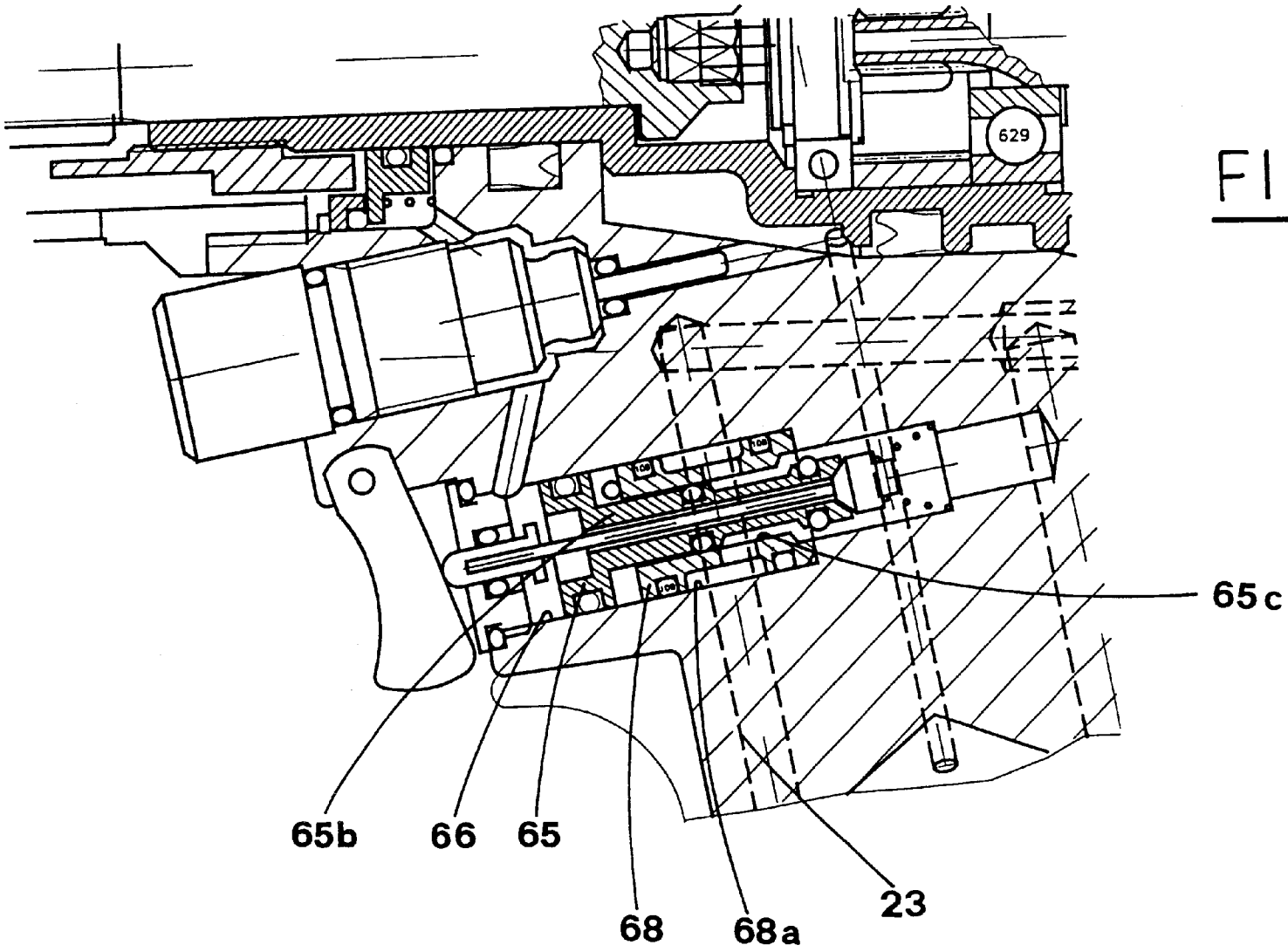

This makes the closing pinhead 67 free the axial hole 65*a* of the piston 65 and let the compressed air be fed, through the connecting duct 62, into the clearance 74 of the discharge valve 63 (FIG. 12).

From the clearance 74, the compressed air flows also to the bottom 5*a* of the channel 5, in the region of another discharge valve 90, and pushes the ring 91.

The pressure of the air acting on the front part of the piston 65 of the inlet valve 61 causes the axial movement of the piston 65 inside the seat 66 (FIG. 12).

This makes the air flow to the ring-like groove 68*a* of the jacket 68, through the corresponding groove 65*c* of the tubular shank 65*b* of the piston 65 and then, to the feed-discharge duct 23.

The duct 23 feeds the air to the pneumatic cylinder 21.

Figure 1A:
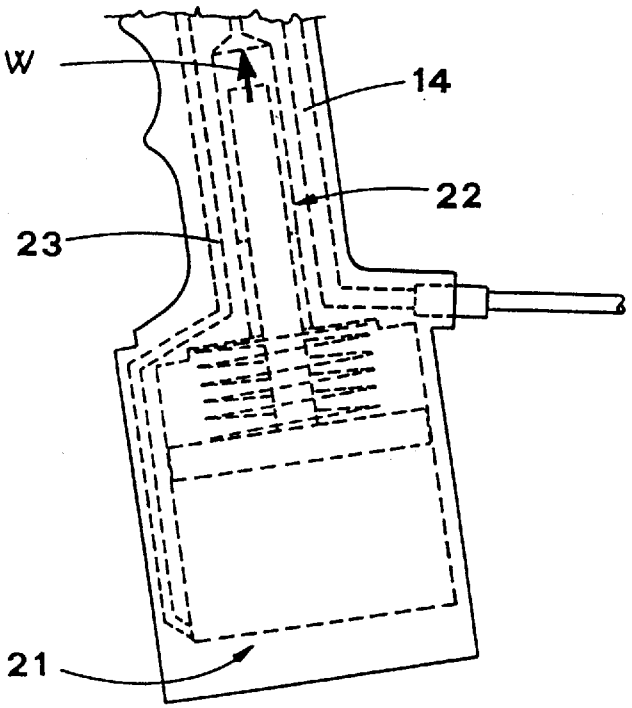
FIG. 1*a* shows a schematic side view of the handle of the rivet gun of FIG. 1, in different operative conditions.

Subsequently, the piston 25 is pushed upwards and, likewise its stem 21*a* is pushed in upward direction W, so as to provoke a sudden supply of oil under pressure to the expansible chamber 10 (FIG. 1*a*).

Figure 7:
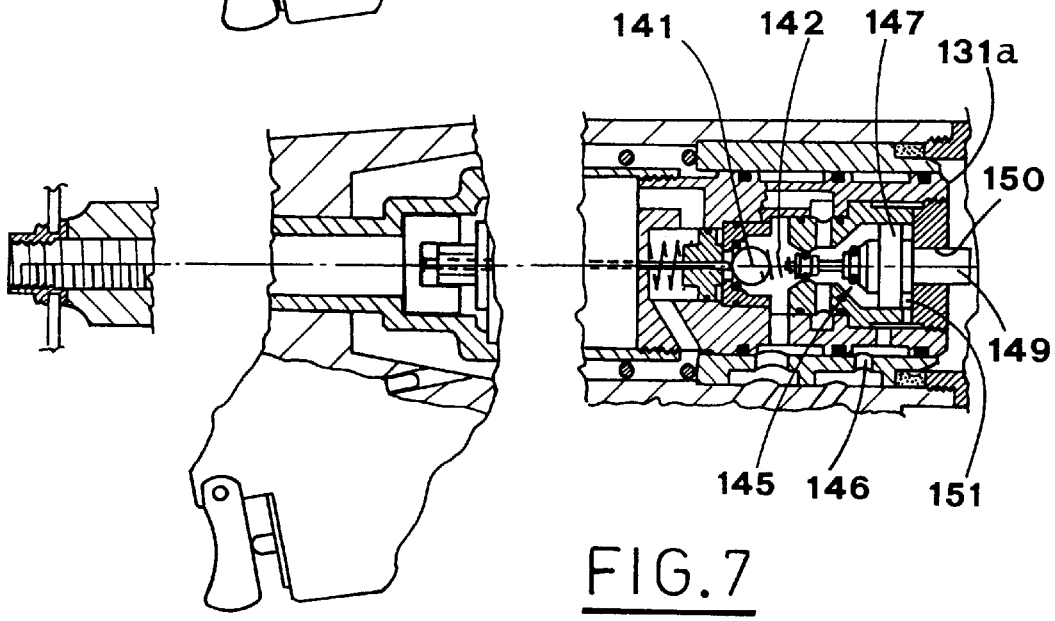

This causes a sudden and determined withdrawal of the sleeve-like element 9 and therefore, of the segmented stem 7, which in its turn stresses axially the rivet 2, deforming it partially and fastening it to the laminate structure 100 (FIGS. 6,7).

It is to be pointed out that the user can immediately release the trigger 64, since the gun working cycle continues automatically after the starting impulse.

The withdrawal of the sleeve-like element 9 continues until the ring nut 29 strikes the ring 91, making it moved rearwards.

Figure 13:
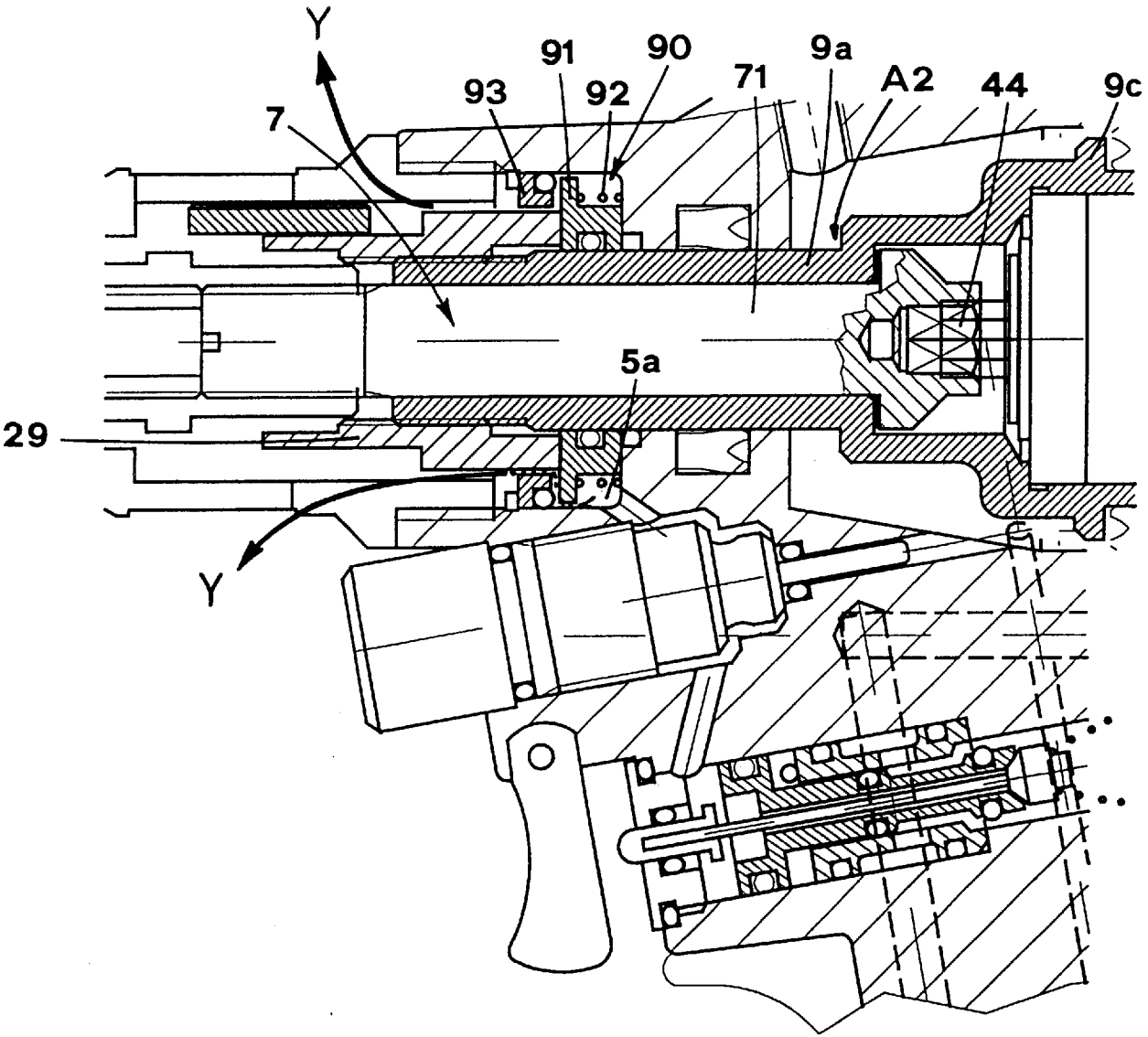

This causes the discharge valve 90 opening and consequently, allows the air to flow through suitable radial holes made in the fore channel 5, as indicated with the arrows Y in FIG. 13.

Screwing more or less the ring nut 29 on the element 9 the stroke of the element 9 can be adjusted within the maximum predetermined value, so that the traction force imposed to the rivet 2 is kept constant no matter of the stroke.

As an alternative, the discharged compressed air can flow through the discharge valve 63, in accordance with a predetermined pressure of the oil fed to the expansible chamber 10.

The withdrawal of the sleeve-like element 9 and consequently, the rivet 2 buckling is gradually opposed by increasing resistance to the compression given by the group rivet 2-laminate structure 100 assembly.

This increases the pressure of the oil still supplied to the expansible chamber 10.

This pressure pushes axially the shank 78*a* of the closing bolt 78 against the action of the helical spring 77, whose reaction is adjusted by the adjustment ring 176.

Figure 14:
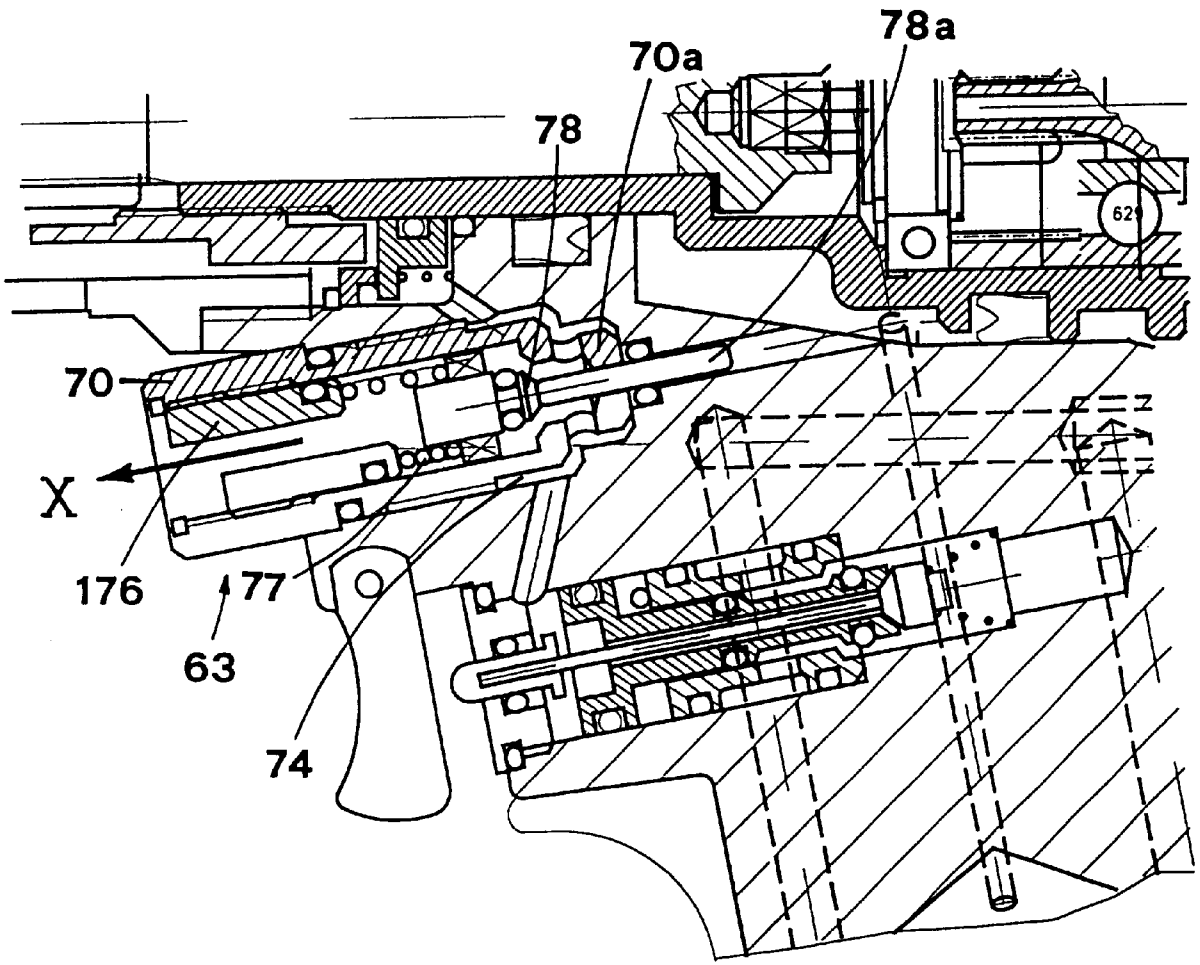

When the oil pressure reaches a level high enough to move the closing bolt 78, the air is discharged, as indicated with the arrow X in FIG. 14, through the central hole made in the adjustment ring 176, outside the discharge valve 63.

In order to obtain a desired stroke, a pressure higher than necessary is imposed, or otherwise, to determine the desired pressure, the maximum stroke value is imposed.

This means that each of the operation way, with pressure value or stroke length priority, requires a suitable adjustment of the other non-priority parameter.

In both described situations, the discharge of the compressed air contained between the bottom 5*a*, the duct 75, the clearance 74 and the connecting duct 62, causes the closure of the inlet valve 61, and the piston 65 and the closing pinhead 67 return to the inoperative position due to the push of the helical spring 69.

In this way, the feed-discharge duct 23 is closed, the pneumatic cylinder 21 is no longer fed and the piston 25 is stopped.

A part of compressed air contained in the pneumatic cylinder 21 goes out by the exhaust duct 17, through the flow registering valve 83, more or less rapidly in relation to adjustment of this valve.

Figure 8:
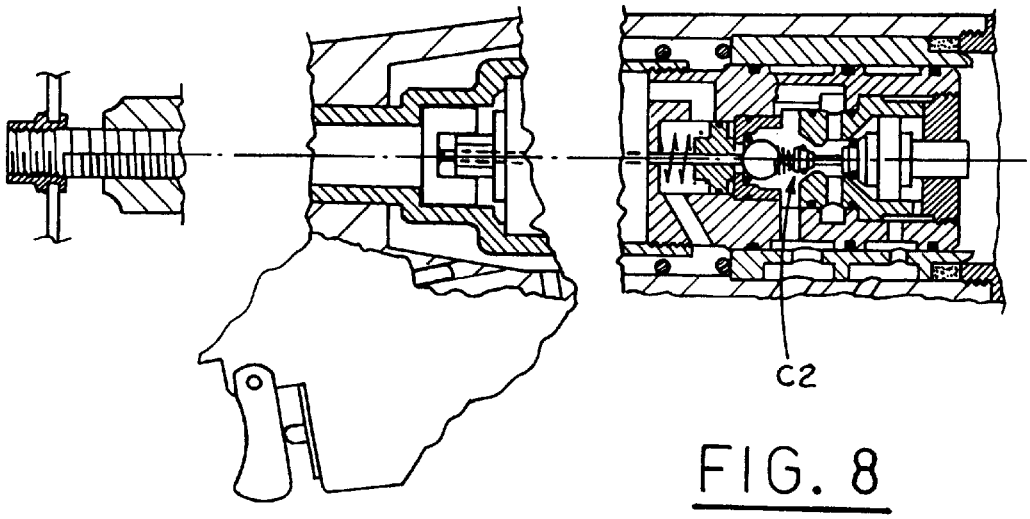

The remaining air enters the rear chamber 137 through the reverse operation control channel 146, thus bringing the second reverse operation block to its forwarded position C2 (FIG. 8).

This breaks the communication between the bore 144 and the rear chamber 137 and opens the communication between the bore 144 and the intermediate chamber 136.

Therefore, the compressed air present in this intermediate chamber 136 can flow, in direction opposite to the one described above, to the bore 144 and from there to the discharge duct 133, then to the motor 4.

In this way, the motor is driven in a reverse, or counter-clockwise rotation, and the compressed air going out thereof through the input duct 42, flows to the supply duct 132, and subsequently to the fore chamber 135.

From the fore chamber 135 the air enters the for-reverse-rotation discharge duct 138, the ring-like chamber 13 and finally, through the fin structure 81, flows into the outlet chamber 82.

Obviously, the reverse rotation of the motor 4 makes the terminal portion 175 unscrew from the rivet 2.

It is to be noted that, since the air pressure is the same and the resistance opposed by the flow path does not vary substantially with respect to the direct rotation condition, the motor 4 can rotate in the reverse direction with the resulting torque comparable to the one obtained by the direct rotation.

When the pneumatic cylinder 21 has been emptied from all the air, the second reverse operation block 145 is brought back to the rearward position C1 and the flow of air to the motor 4 stops.

The motor working time can be adjusted by acting on the flow adjustment valve 83.

A ball-like check valve 215, situated in the duct 17 for facilitating this adjustment (see FIG. 1), allows the flow only toward the rear part of the duct 17.

If the portion 175 is not completely unscrewed from the rivet 2, due to e.g. incorrect adjustment of the flow adjustment valve 83, it is sufficient to press the button 18, which pushes the second reverse operation block 145, so as to bring it back to the forwarded position C2 and consequently, to restore the above described motor 4 reverse rotation condition, until the portion 175 is completely unscrewed.

For a correct operation of the proposed rivet gun, it is necessary that the user, after having pressed the trigger to the end, release it immediately without dwelling.

A device 240, associated to the trigger 64, allows to free the gun operation from the operator's ability and/or experience.

This device 240, illustrated in FIGS. 15*a*–15*e*, sends a control impulse to the trigger 64, independently from the fact, that this trigger has been pressed or released more or less rapidly.

In fact, the device 240 is connected to the trigger 64 and includes a prismatic ratchet 244 and elastic means 245.

The trigger is pivoted to the casing by means of a pivot pin 205. The ratchet 244 is carried rotatably by the trigger 64, and is situated below this pin 205 with rotation axis parallel thereto.

The elastic means 245 push the ratchet 244 upward beside its pivot point, so as to impose the ratchet a torque in a direction that keeps it in a predetermined configuration Z, defined by a stop 241, formed by the trigger.

The trigger 46 is provided, in known way, with elastic means 246, which keep it in an inoperative position R (FIGS. 15*a*, 15*e*), moved away from the button 61*a*.

In the configuration Z, a corner 244*a* of the ratchet 244 can strike and press the button 61*a*, when the trigger 64 is moved by the operator against the elastic means 246.

Figures 15A, 15B, 15C, 15D, 15E:
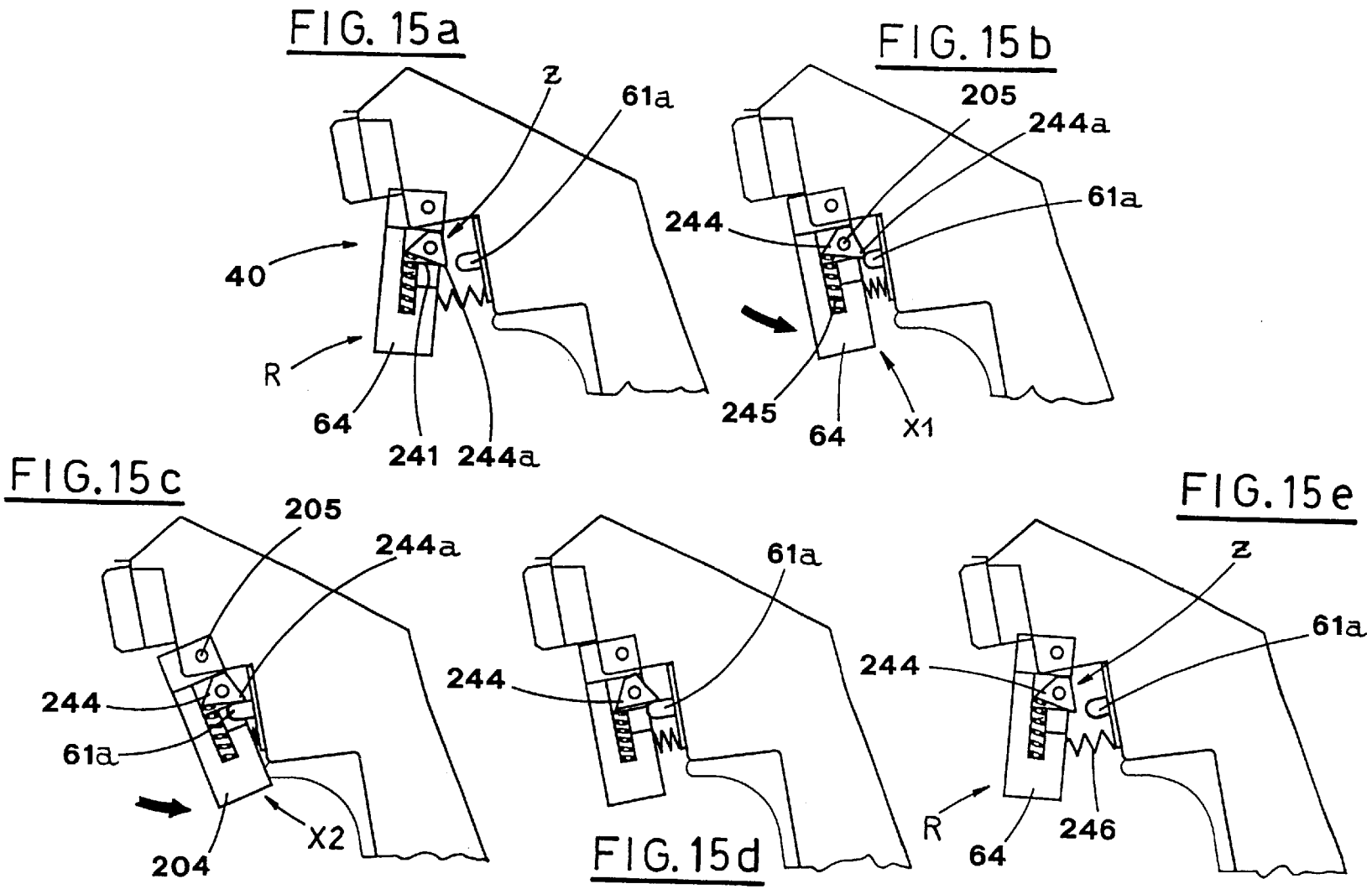
FIGS. 15*a*,15*b*,15*c*,15*d* and 15*e* show schematic views of a mechanical device which, according to an interesting embodiment, can be joined to the gun trigger.

The corner 244*a* of the ratchet 244 presses the button 61*a* until the trigger 64 has performed a first predetermined rotation, beginning from the inoperative position R up to the position indicated with X1 in FIG. 15*b*.

When the trigger is rotated further to the end, i.e. to the position X2 indicated in FIG. 15*c*, the corner 244*a* of the ratchet 244 is raised with respect to the button 61*a*, so as not to interfere with it.

Therefore, the button 61*a* is released by the ratchet 244, and it can return to its initial position, according to the automatic operation cycle of the rivet gun 1 and independently from the fact that the operator has released the trigger 64 more or less rapidly, or has not released it at all.

FIGS. 15*c*, 15*d* show the trigger 64 while returning to its inoperative position R due to the action of elastic means 246, after having been released by the operator.

The same Figures point out the fact that the button 61*a* does not hinder the trigger, since the button rotates the ratchet 244 in contrast to the elastic means 245. The ratchet snaps beyond the tip of the button 61*a* and then return to its predetermined configuration Z.

Consequently, the proposed rivet gun can be operated by a pressure on the button 61*a* independently from the operator's way of using the trigger.

Moreover, it is to be pointed out that the elastic means 245 and 246 have a very soft reaction, since they have to perform very mild action, therefore the device 240 does not make the trigger 64 operation more difficult or heavy.

The advantages of the present invention derive from the fact that the proposed pneumatic-hydraulic rivet gun is equally efficient during both the rivet screwing and unscrewing, after the rivet have been buckled.

Another undeniable advantage lies in the fact that for the proposed pneumatic-hydraulic rivet gun both the stroke and the rivets tightening pressure can be adjusted, thus giving one or the other parameter the priority, in relation to the functional needs.

When the stroke is adjusted, the ring nut 29 is acted on, so as to change the element 9 stroke, within the maximum determined value. Doing so, the traction force imposed to the rivet 2 is dimensionally constant.

In this case, the sleeve-like element 9 goes back until the ring nut 29 strikes the ring 91, thus opening the discharge valve 90.

If the pressure is to be adjusted, the compressed air flows through the discharge valve 63 in relation to a predetermined pressure of the oil fed to the expansible chamber 10. The oil pressure is in this case adjusted by the adjustment ring 176.

When this pressure is reached, the discharge valve 63 opens and consequently, the working cycle stops.

In practice, any of the described adjustment systems, which is regulated first, determines the compressed air discharge and consequently, the working cycle stop, thus providing double safety conditions.

Suitably, sensor means 111 are joined to the casing 1 of the gun for controlling the value of the oil pressure in the chamber 10.

Another advantage of the present invention results from extreme simplicity and functionality of its controls.

In fact, the user must only press slightly the segmented stem 7 and therefore, the trigger 64, since the working cycle continues automatically.

There are no push buttons or levers, or activators to be operated.

Yet a further advantage of the proposed rivet gun results from its considerable compactness and easy handling.

A further advantage derives from the fact that parts of low cost and readily available on the market can be used as the intermediate and fore segments of the segmented shaft.

What is claimed is:

1. A pneumatic-hydraulic operated rivet gun comprising;

an elongated casing (1) having a fore end, a rear end, a rear cavity (3) and a substantially cylindrical fore channel (5) aligned with said rear cavity (3) along a longitudinal axis, said fore channel (5) connected to said rear cavity (3) and being opened in a region of the fore end (6) of said casing (1);

at least one pneumatic motor (4) housed axially within said rear cavity (3), said motor having an air input duct and an air output duct;

at least one segmented stem (7), located in said fore channel (5) in succession with said pneumatic motor (4), and having a threaded terminal portion (175) extending from said fore end (6) for receiving an internally threaded rivet (2), said pneumatic motor (4) and said segmented stem (7) sliding axially and in opposite directions within said rear cavity (3) and fore channel (5);

first elastic means (8) acting on said pneumatic motor and said segmented stem;

said motor having an output shaft (41) axially connected with said stem;

at least one hollow handle (20) extending from a side **(1*a*) of said casing (1) and containing at least one pneumatic cylinder (21), the hollow handle having a handle-connecting part (20*b*) having at least one hydraulic cylinder (22) therein, operated by said pneumatic cylinder (21) for axially sliding said pneumatic motor (4) and said segmented stem (7)**;

a change-over switching device (30), located within said rear cavity (3), said pneumatic motor (4) having an input duct (42), at least one pneumatic supply duct (132) connecting said change-over switching device to said input duct (42), an infeed duct 14 for supplying a flow of compressed air to said input duct (42) for supplying said pneumatic motor (4) with compressed air for direct rotation of said pneumatic motor;

said pneumatic motor having a discharge duct (43), at least one pneumatic discharge duct (133) connected to said change-over switching device and to said discharge duct (43) for discharging said compressed air during direct rotation of said pneumatic motor;

first control means (50) for determining direct rotation of said pneumatic motor;

second control means (60) for toggling said change-over switching device to supply a flow of compressed air to said pneumatic motor via said discharge duct (133) for reverse rotation of said pneumatic motor, and for discharging said compressed air via said supply duct (132);

said second control means (60) having an inlet valve (61), a trigger (64) for manually operating said inlet valve, said pneumatic cylinder having a feed-discharge duct (23), the inlet valve operative to connect said compressed air infeed duct (14) with the feed-discharge duct (23), said inlet valve having a seat (66) located in said handle, a piston (65) slidably mounted in said seat (66), a push button **(61*a*) operatively connected to the trigger (64), a tubular shank (65*b*) of said piston (65) having an axial hole (65*a*), a pin (61*b*) fastened axially to said push button (61*a*) and passing freely through said axial hole (65*a*), a closing pinhead (67) located at an end of said pin (61*b*) for closing said axial hole (65*a*) to break communication between said compressed air infeed duct (14) and said feed-discharge duct (23) of said pneumatic cylinder (21)**;

a first discharge valve (63), arranged in series with said inlet valve (61), a connecting duct (62) connecting the discharge valve to the inlet valve, the first discharge valve having means (176) for adjusting a maximum pressure of said hydraulic cylinder (22).

2. The rivet gun according to claim 1 further comprising:

a jacket (68) mounted within said seat (66), said tubular shank **(65*b*) slidable tightly within said jacket, a ring-like groove (68*a*)**, formed externally on said jacket, said tubular shank having an outer surface containing a groove, said feed-discharge duct connected to said ring-like groove through a plurality of radial holes made in said jacket for connecting said ring-like groove with the groove in the outer surface of said tubular shank.

3. The rivet gun according to claim 1 further comprising elastic means (69) for biasing said closing pinhead (67) against a bottom **(66*a*) of said seat (66), so as to close said axial hole (65*a*)**.

4. The rivet gun according to claim 1 further comprising a second discharge valve (90), arranged in series with said first discharge valve (63);

a connecting duct (75) for connecting said second discharge valve with said first discharge valve;

means (29) for adjusting a stroke of said segmented stem (7);

a sleeve-like element body 9 disposed to slidably support said segmented stem (7);

a ring (91) located in said second discharge valve (90) and slidably mounted on said sleeve-like element body (9);

a shoulder ring (93) located within said fore channel (5); and, elastic means (92) resting on a bottom region (5*a*) of said fore channel (5) for biasing said ring into sealing engagement against said shoulder ring.

5. The rivet gun according to claim 1, further comprising a cylindrical sleeve element (9), said pneumatic motor (4) and a rear segment (73) of said segment stem (7) housed within the cylindrical sleeve-like element (9), the cylindrical sleeve element having a fore cylindrical portion (9*a*), an intermediate cylindrical portion (9*b*) and a rear cylindrical portion (9*c*) each portion having a diameter larger that a previous portion, respectively, said fore portion (9*a*) located in said fore channel (5) and receiving slidably said rear segment (73), said intermediate portion (9*b*) and said rear portion (9*c*) located in said rear cavity (3), shape coupling means located in said intermediate portion and said rear portion, between said segment stem (7) and pneumatic motor (4); said cylindrical body being slidable axially between a forward position (A1) and a rearward position (A2).

6. The rivet gun according to claim 5 wherein said intermediate portion (9*b*) and a part of said rear portion (9*c*) of said cylindrical sleeve element (9) form a liquid-tight expansible chamber (10) within said rear cavity (3).

7. The rivet gun according to claim 1, wherein said segment stem (7) has a rear segment (71), a socket head (76) formed at an end of said rear segment (71), the output shaft having a polygonal head, the socket head engaged with said polygonal head (44); the segment stem having an intermediate segment (72), which is axially and removably engaged with said rear segment (71); the segment stem having a fore segment (73), which is axially and removably engaged with said intermediate segment (72), the fore segment protruded from said fore end (6) of the casing (1).

8. The rivet gun according to claim 7 wherein said intermediate segment (72) has a socket head connecting element, and said fore segment (73) has a socket head screw.

9. The rivet gun according to claim 1 further comprising a mechanical device (240) having a pivot pin 205, joined to said trigger (64) and having a prismatic ratchet (244) hinged to said trigger (64), a hinge axis thereof being parallel to the pivot pin (205), the trigger having a stop (241);

elastic means (245) urging said ratchet (244) toward said stop in a configuration (Z);

said ratchet having a corner (244*a*) engagable with said button (61*a*) by rotation of said trigger (64), said trigger having an idle position (R), said ratchet (244) being brought, by rotation of said trigger (64) about the hinge axis to a position in which the ratchet is out of contact with said button (61*a*), thereby releasing said button (61*a*).

10. The rivet gun, according to claim 9 wherein said elastic means (245) cause said ratchet (244) to snap beyond said button (61*a*) when said trigger (64) is released and further comprise an elastic means (246) joined thereto for biasing said ratchet to said inoperative position (R).

11. A pneumatic-hydraulic operated rivet gun comprising;

an elongated casing (1) having a fore end, a rear end, a rear cavity (3) and a substantially cylindrical fore channel (5) aligned with said rear cavity (3) along a longitudinal axis, said fore channel (5) connected to said rear cavity (3) and being opened in a region of the fore end (6) of said casing (1);

at least one pneumatic motor (4) housed axially within said rear cavity (3), said motor having an air input duct and an air output duct;

at least one segmented stem (7), located in said fore channel (5) in succession with said pneumatic motor (4), and having a threaded terminal portion (175) extending from said fore end (6) for receiving an internally threaded rivet (2), said pneumatic motor (4) and said segmented stem (7) sliding axially and in opposite directions within said rear cavity (3) and fore channel (5);

first elastic means (8) acting on said pneumatic motor and said segmented stem;

said motor having an output shaft (41) axially connected with said stem;

at least one hollow handle (20) extending from a side (1*a*) of said casing (1) and containing at least one pneumatic cylinder (21), the hollow handle having a handle-connecting part (20*b*) having at least one hydraulic cylinder (22) therein, operated by said pneumatic cylinder (21) for axially sliding said pneumatic motor (4) and said segmented stem (7);

a change-over switching device (30), located within said rear cavity (3), said pneumatic motor (4) having an input duct (42), at least one pneumatic supply duct (132) connecting said change-over switching device to said input duct (42), an infeed duct 14 for supplying a flow of compressed air to said input duct (42) for supplying said pneumatic motor (4) with compressed air for direct rotation of said pneumatic motor;

said pneumatic motor having a discharge duct (43), at least one pneumatic discharge duct (133) connected to said change-over switching device and to said discharge duct (43) for discharging said compressed air during direct rotation of said pneumatic motor;

first control means (50) for determining direct rotation of said pneumatic motor;

second control means (60) for toggling said change-over switching device to supply a flow of compressed air to said pneumatic motor via said discharge duct (133) for reverse rotation of said pneumatic motor, and for discharging said compressed air via said supply duct (132);

said second control means (60) having an inlet valve (61), a trigger (64) for manually operating said inlet valve, said pneumatic cylinder having a feed-discharge duct (23), the inlet valve operative to connect said compressed air infeed duct (14) with the feed-discharge duct (23));

a first discharge valve (63), arranged in series with said inlet valve (61), a connecting duct (62) connecting the discharge valve to the inlet valve, the first discharge valve having means (176) for adjusting a maximum pressure of said hydraulic cylinder (22), said first discharge valve (63) having an internally threaded hollow body (70), located within a seat in the casing, the seat having a bottom region;

a tubular prominence (70*a*) protruding from said body;

a clearance (74) defined at said bottom region between said seat and said hollow body, said clearance being connected to said connecting duct (62);

an adjustment ring (176) screwed into said hollow body;

a closing bolt (78) located adjacent to said tubular prominence and being responsive to pressure exerted by said hydraulic cylinder (22);

elastic means (77) placed between said adjusting ring and said closing bolt, for biasing said closing bolt to sealingly close said tubular prominence.

12. The rivet gun according to claim 11 further comprising a shank (78*a*) slidably disposed in a hole (110), an expansible chamber (10) in communication with said hole (110), said expansible chamber 10 suppliable with hydraulic liquid under pressure by said hydraulic cylinder (22), said closing bolt being axially guided driven by said shank (78*a*).

13. The rivet gun according to claim 11 wherein said tubular prominence (70*a*) has radial holes (70*b*) in communication with said clearance (74).

14. The rivet gun according to claim 11 further comprising a second discharge valve (90), arranged in series with said first discharge valve (63);

a connecting duct (75) for connecting said second discharge valve with said first discharge valve;

means (29) for adjusting a stroke of said segmented stem (7);

a sleeve-like element body 9 disposed to slidably support said segmented stem (7);

a ring (91) located in said second discharge valve (90) and slidably mounted on said sleeve-like element body (9);

a shoulder ring (93) located within said fore channel (5); and, elastic means (92) resting on a bottom region (5*a*) of said fore channel (5) for biasing said ring into sealing engagement against said shoulder ring.

15. A pneumatic-hydraulic operated rivet gun comprising;

an elongated casing (1) having a fore end, a rear end, a rear cavity (3) and a substantially cylindrical fore channel (5) aligned with said rear cavity (3) along a longitudinal axis, said fore channel (5) connected to said rear cavity (3) and being opened in a region of the fore end (6) of said casing (1);

at least one pneumatic motor (4) housed axially within said rear cavity (3), said motor having an air input duct and an air output duct;

at least one segmented stem (7), located in said fore channel (5) in succession with said pneumatic motor (4), and having a threaded terminal portion (175) extending from said fore end (6) for receiving an internally threaded rivet (2), said pneumatic motor (4) and said segmented stem (7) sliding axially and in opposite directions within said rear cavity (3) and fore channel (5);

first elastic means (8) acting on said pneumatic motor and said segmented stem; said motor having an output shaft (41) axially connected with said stem; at least one hollow handle (20) extending from a side (1*a*) of said casing (1) and containing at least one pneumatic cylinder (21), the hollow handle having a handle-connecting part (20*b*) having at least one hydraulic cylinder (22) therein, operated by said pneumatic cylinder (21) for axially sliding said pneumatic motor (4) and said segmented stem (7);

a change-over switching device (30), located within said rear cavity (3), said pneumatic motor having a rear head (4*a*), said change-over switching device firmly fastened to the rear head (4*a*), coaxial therewith, said change-over switching device sliding axially together with said motor (4) and said segment stem (7), said pneumatic motor (4) having an input duct (42), at least one pneumatic supply duct (132) connecting said change-over switching device to said input duct (42), an infeed duct 14 for supplying a flow of compressed air to said input duct (42) for supplying said pneumatic motor (4) with compressed air for direct rotation of said pneumatic motor;

said pneumatic motor having a discharge duct (43), at least one pneumatic discharge duct (133) connected to said change-over switching device and to said discharge duct (43) for discharging said compressed air during direct rotation of said pneumatic motor;

first control means (50) for determining direct rotation of said pneumatic motor;

second control means (60) for toggling said change-over switching device to supply a flow of compressed air to said pneumatic motor via said discharge duct (133) for reverse rotation of said pneumatic motor, and for discharging said compressed air via said supply duct (132);

a discharge valve (63), arranged in series with said inlet valve (61), a connecting duct (62) connecting the discharge valve to the inlet valve, the discharge valve having means (176) for adjusting a maximum pressure of said hydraulic cylinder (22).

16. The rivet gun according to claim 15, wherein said change-over switching device (30) comprises:

a substantially cylindrical body (131);

a plurality of air-tight chambers made in said cylindrical body and communicating with each other, a fore chamber (135) situated close to said pneumatic motor (4), an intermediate chamber (136), a rear chamber (137); and a bore (144), connecting said intermediate chamber (136) and said rear chamber (137), with said supply duct (132) and extending from said fore chamber (135) up to said input duct (42) of said pneumatic motor (4), said discharge duct (133) extending from said bore (144) to said output duct (43) of said pneumatic motor (4);

at least one discharge duct (138) extending from said fore chamber (135) to a discharge ring-like chamber (13), located within said casing (1);

a first reverse operation block (139), sliding tightly inside said fore chamber (135), between a rearward (B1) and a forward position (B2);

second elastic means (32) acting on said first reverse operation block;

a first valve (141), situated between said fore chamber (135) and said intermediate chamber (136), and operated by said first control means (50) for controlling a flow of compressed air between said fore chamber and said intermediate chamber;

third elastic means (142) acting on said first valve (141);

at least one compressed air inlet duct (143) located between said intermediate chamber (136) and said infeed duct (14);

a second reverse operation block (145), sliding axially and tightly within said rear chamber (137) for preventing communication alternatively between said intermediate chamber (136) and said bore (144) and between said rear chamber (137) and said bore (144), said second reverse operation block (145) moving against said third elastic means (142) of said first valve (141);

at least one reverse operation control channel (146) located in said rear chamber (137) for connecting said rear chamber (137) and an exhaust duct (17) of said pneumatic cylinder (21).

17. The rivet gun according to claim 16 wherein said second reverse operation block (145) comprises:

a plunger (147), slidable within said rear chamber (137) and having a rear part, the rear part being a cylindrical hollow extension (149), a rear end (131*a*) of said body (131) having a corresponding axial hole (150) for receiving the extension (149), and for connecting said rear chamber (137) with said rear cavity (3);

a twin valve (148), fastened axially on a front surface of the plunger (147) for preventing communication alternatively between said bore (144) and said intermediate chamber (136), and between said bore (144) and said rear chamber (137);

a ring-like recess (151) located behind said sealing cylinder (147) and disposed around said cylindrical hollow extension (149).

18. The rivet gun according to claim 16 further comprising a first ring groove (152) and a second ring groove (153) located on an external surface of said body (131), said grooves communicating respectively between said intermediate chamber (136) and said infeed duct (14), and between said rear chamber (137) and said reverse operation control channel (146).

19. The rivet gun according to claim 16, wherein said exhaust duct (17) exits the casing (1) at a rear end (1*b*) of said casing (1), a flow adjustment valve (83) disposed in said exhaust duct.

20. The rivet gun according to claim 19 wherein said exhaust duct (17) has a check valve (215) therein to allow air flow in only one direction.

21. A pneumatic-hydraulic operated rivet gun comprising;

an elongated casing (1) having a fore end, a rear end, a rear cavity (3) and a substantially cylindrical fore channel (5) aligned with said rear cavity (3) along a longitudinal axis, said fore channel (5) connected to said rear cavity (3) and being opened in a region of the fore end (6) of said casing (1);

at least one pneumatic motor (4) housed axially within said rear cavity (3), said motor having an air input duct and an air output duct;

at least one segmented stem (7) having a socket head (76), located in said fore channel (5) in succession with said pneumatic motor (4), and having a threaded terminal portion (175) extending from said fore end (6) for receiving an internally threaded rivet (2), said pneumatic motor (4) and said segmented stem (7) sliding axially and in opposite directions within said rear cavity (3) and fore channel (5);

first elastic means (8) acting on said pneumatic motor and said segmented stem; said motor having an output shaft (41) axially connected with said stem; the output shaft having a polygonal head, at least one hollow handle (20) extending from a side (1*a*) of said casing (1) and containing at least one pneumatic cylinder (21), the hollow handle having a handle-connecting part (20*b*) having at least one hydraulic cylinder (22) therein, operated by said pneumatic cylinder (21) for axially sliding said pneumatic motor (4) and said segmented stem (7);

a change-over switching device (30) having axial holes therein, located within said rear cavity (3), said pneumatic motor (4) having an input duct (42), at least one pneumatic supply duct (132) connecting said change-over switching device to said input duct (42), an infeed duct 14 for supplying a flow of compressed air to said input duct (42) for supplying said pneumatic motor (4) with compressed air for direct rotation of said pneumatic motor;

said pneumatic motor having a discharge duct (43), at least one pneumatic discharge duct (133) connected to said change-over switching device and to said discharge duct (43) for discharging said compressed air during direct rotation of said pneumatic motor;

first control means (50) for determining direct rotation of said pneumatic motor;

second control means (60) for toggling said change-over switching device to supply a flow of compressed air to said pneumatic motor via said discharge duct (133) for reverse rotation of said pneumatic motor, and for discharging said compressed air via said supply duct (132);

said second control means (60) having an inlet valve (61), a trigger (64) for manually operating said inlet valve, said pneumatic cylinder having a feed-discharge duct (23), the inlet valve operative to connect said compressed air infeed duct (14) with the feed-discharge duct (23);

a first discharge valve (63), arranged in series with said inlet valve (61), a connecting duct (62) connecting the discharge valve to the inlet valve, the first discharge valve having means (176) for adjusting a maximum pressure of said hydraulic cylinder (22);

said first control means (50) including said segment stem (7); and a rod (51), said rod (51) being situated between a first valve (141) of said change-over switching device (30) and said polygonal head (44) of said output shaft (41) in coaxial relation therewith, said rod (51) and said output shaft (41) sliding in said axial holes in said change-over switching device (30) said rod (51) having a fore end in contact with said socket head (76).

22. A pneumatic-hydraulic operated rivet gun comprising;

an elongated casing (1) having a fore end, a rear end, a rear cavity (3) and a substantially cylindrical fore channel (5) aligned with said rear cavity (3) along a longitudinal axis, said fore channel (5) connected to said rear cavity (3) and being opened in a region of the fore end (6) of said casing (1):

at least one pneumatic motor (4) housed axially within said rear cavity (3), said motor having an air input duct and an air output duct;

at least one segmented stem (7), located in said fore channel (5) in succession with said pneumatic motor (4), and having a threaded terminal portion (175) extending from said fore end (6) for receiving an internally threaded rivet (2), said pneumatic motor (4) and said segmented stem (7) sliding axially and in opposite directions within said rear cavity (3) and fore channel (5);

first elastic means (8) acting on said pneumatic motor and said segmented stem;

said motor having an output shaft (41) axially connected with said stem;

at least one hollow handle (20) extending from a side (1*a*) of said casing (1) and containing at least one pneumatic cylinder (21), the hollow handle having a handle-connecting part (20*b*) having at least one hydraulic cylinder (22) therein, operated by said pneumatic cylinder (21) for axially sliding said pneumatic motor (4) and said segmented stem (7);

a change-over switching device (30), located within said rear cavity (3), said pneumatic motor (4) having an input duct (42), at least one pneumatic supply duct (132) connecting said change-over switching device to said input duct (42), an infeed duct 14 for supplying a flow of compressed air to said input duct (42) for supplying said pneumatic motor (4) with compressed air for direct rotation of said pneumatic motor;

said pneumatic motor having a discharge duct (43), at least one pneumatic discharge duct (133) connected to said change-over switching device and to said discharge duct (43) for discharging said compressed air during direct rotation of said pneumatic motor;

first control means (50) for determining direct rotation of said pneumatic motor;

second control means (60) for toggling said change-over switching device to supply a flow of compressed air to said pneumatic motor via said discharge duct (133) for reverse rotation of said pneumatic motor, and for discharging said compressed air via said supply duct (132);

said second control means (60) having an inlet valve (61), a trigger (64) for manually operating said inlet valve, said pneumatic cylinder having a feed-discharge duct (23), the inlet valve operative to connect said compressed air infeed duct (14) with the feed-discharge duct (23);

a first discharge valve (63), arranged in series with said inlet valve (61), a connecting duct (62) connecting the discharge valve to the inlet valve, the first discharge valve having means (176) for adjusting a maximum pressure of said hydraulic cylinder (22);

a starting device (18) for driving said pneumatic motor (4) into reverse rotation independently from the position of said segment stem (7), by acting on said change-over switching device (30).

* * * * *